US011083316B1

(12) United States Patent
Pierson et al.

(10) Patent No.: US 11,083,316 B1
(45) Date of Patent: Aug. 10, 2021

(54) RECYCLABLE AND DISPENSABLE CUTLERY UTENSIL

(75) Inventors: Mark V. Pierson, Binghamton, NY (US); Anthony D'Amelia, Binghamton, NY (US)

(73) Assignee: Waddington North America, Inc., Chelmsford, MA (US)

( * ) Notice: Subject to any disclaimer, the term of this patent is extended or adjusted under 35 U.S.C. 154(b) by 141 days.

(21) Appl. No.: 13/161,767

(22) Filed: Jun. 16, 2011

Related U.S. Application Data

(63) Continuation-in-part of application No. 12/831,396, filed on Jul. 7, 2010, now Pat. No. 8,272,533.

(51) Int. Cl.
*A47G 21/06* (2006.01)
*A47G 21/02* (2006.01)
*A47F 1/10* (2006.01)

(52) U.S. Cl.
CPC ..... *A47G 21/06* (2013.01); *A47G 21/023* (2013.01); *A47F 2001/103* (2013.01)

(58) Field of Classification Search
CPC .... A47G 21/06; A47G 21/02; A47F 2001/103
USPC ..... 30/142, 147–150, 322–328
See application file for complete search history.

(56) References Cited

U.S. PATENT DOCUMENTS 512,162 A * 1/1894 cuddy ..... A47G 21/02 294/12
2,141,684 A 12/1938 Diemer
2,149,099 A 2/1939 Phinney et al.
2,216,005 A * 9/1940 Goldstein ..... 30/122
2,752,678 A * 7/1956 Welch ..... 30/324
2,911,127 A 11/1959 Dress et al.
3,635,350 A 1/1972 Wolf
3,987,901 A 10/1976 Dullinger
(Continued)

FOREIGN PATENT DOCUMENTS

CN 101066183 A 11/2007
JP 2002211633 A 7/2002
(Continued)

OTHER PUBLICATIONS

Office Action dated May 18, 2020 for European Appl. No. 17779770.1, 3 pages.
(Continued)

*Primary Examiner* — Ghassem Alie
*Assistant Examiner* — Fernando A Ayala
(74) *Attorney, Agent, or Firm* — Maine Cernota & Rardin

(57) ABSTRACT

Recyclable and dispensable hygienic cutlery utensil. A preferred embodiment of the present invention includes a handle portion and head portion. The handle portion provides suitable area for gripping and includes a chamfer on its outer edge for facilitating a predictable release from a utensil dispenser. The head portion is formed into the shape of a common cutlery utensil such as: knife with large radius, tapered knife with large radius, spoon, set of tines (fork), and spoon-fork combination, to name a few. The head portion also includes an escapement feature in its outer edge for facilitating controlled release from the bottom of a stack of utensils. The escapement feature can include a notch or predetermined release radius. Typically in use, a set of utensils is stacked, forming a cartridge which is then inserted into an automated dispensing system.

19 Claims, 12 Drawing Sheets

(56) References Cited

U.S. PATENT DOCUMENTS

| | | | | |
|---|---|---|---|---|
| 4,134,519 | A | 1/1979 | Barnett et al. | |
| 4,426,056 | A | 1/1984 | Gelardi et al. | |
| D275,167 | S * | 8/1984 | Laslo | D7/653 |
| 4,524,512 | A * | 6/1985 | Formo | A47G 21/06 30/147 |
| 4,539,749 | A * | 9/1985 | Hyeong-Woon | 30/147 |
| 4,610,087 | A * | 9/1986 | Mickelson et al. | 30/147 |
| 4,995,154 | A * | 2/1991 | Bamber | A47G 21/06 30/147 |
| 5,131,562 | A | 7/1992 | Brown | |
| 5,295,592 | A | 3/1994 | Thorne | |
| 5,855,285 | A | 1/1999 | Laird et al. | |
| 5,855,422 | A | 1/1999 | Naef | |
| 5,904,250 | A * | 5/1999 | De Schutter | 206/553 |
| 5,921,408 | A | 7/1999 | Gronewold et al. | |
| 6,250,498 | B1 | 6/2001 | Lovejoy | |
| 6,336,568 | B1 | 1/2002 | Tucker et al. | |
| 6,662,967 | B2 | 12/2003 | Roy | |
| 6,832,694 | B2 | 12/2004 | Goeking et al. | |
| 7,013,568 | B2 * | 3/2006 | Schmidt | 30/147 |
| D584,084 | S | 1/2009 | Tucker et al. | |
| 7,669,732 | B2 | 3/2010 | Njaastad | |
| 7,900,797 | B1 | 3/2011 | Witcraft | |
| 8,272,533 | B1 | 9/2012 | D'Amelia et al. | |
| 8,296,957 | B2 * | 10/2012 | Muehlemann | 30/142 |
| 8,297,473 | B2 * | 10/2012 | Smith | 221/129 |
| 8,839,522 | B2 * | 9/2014 | Walters | A47G 21/06 30/142 |
| 9,049,948 | B2 | 6/2015 | Jongen et al. | |
| 9,226,598 | B1 | 1/2016 | Knope et al. | |
| 9,924,816 | B2 | 3/2018 | Oakes | |
| 10,051,976 | B2 | 8/2018 | Smith | |
| 10,188,226 | B2 | 1/2019 | Babcock et al. | |
| 10,390,631 | B2 | 8/2019 | Smith | |
| 10,779,661 | B2 | 9/2020 | Schoening et al. | |
| 10,881,221 | B2 | 1/2021 | Kennedy et al. | |
| 2002/0112445 | A1 | 8/2002 | Scaduto | |
| 2005/0155229 | A1 | 7/2005 | Lee | |
| 2007/0000136 | A1 * | 1/2007 | Allen et al. | 30/322 |
| 2007/0108141 | A1 | 5/2007 | Smith et al. | |
| 2008/0128445 | A1 | 6/2008 | Huang et al. | |
| 2010/0170915 | A1 | 7/2010 | Reinsel et al. | |
| 2011/0138632 | A1 * | 6/2011 | Wong | 30/149 |
| 2011/0219631 | A1 * | 9/2011 | Hou | A47G 19/02 30/322 |
| 2011/0226797 | A1 | 9/2011 | Reinsel et al. | |
| 2011/0296693 | A1 | 12/2011 | Oakes | |
| 2013/0193157 | A1 | 8/2013 | Jongen et al. | |
| 2015/0041484 | A1 | 2/2015 | Oakes | |
| 2015/0048108 | A1 | 2/2015 | Borke | |
| 2015/0257561 | A1 | 9/2015 | Miksovsky | |
| 2015/0289679 | A1 | 10/2015 | Oakes | |
| 2019/0075940 | A1 | 3/2019 | Pierson | |
| 2019/0223621 | A1 | 7/2019 | Loucks | |

FOREIGN PATENT DOCUMENTS

| | | | | |
|---|---|---|---|---|
| WO | 2001005281 | A1 | 1/2001 | |
| WO | WO-0105281 | A1 * | 1/2001 | A47F 1/10 |

OTHER PUBLICATIONS

Office Action dated Jan. 8, 2019 for U.S. Appl. No. 13/161,767, 8 pages.

Office Action dated Jun. 28, 2019 for U.S. Appl. No. 13/161,767, 8 pages.

Office Action dated Mar. 23, 2020 for U.S. Appl. No. 16/182,185, 24 pages.

PCT International Search Report and Written Opinion for Appl No. PCT/US2017/026202 dated Jul. 11, 2017, 14 pages.

Office Action for U.S. Appl. No. 16/091,835, dated Aug. 3, 2020, 27 Pages.

International Search Report and Written Opinion for PCT Appl. No. PCT/US2020/025001, dated Jul. 14, 2020, 12 Pages.

Office Action for European Patent Appl. No. 17779770.1, dated Nov. 3, 2020, 3 Pages.

Chinese Office Action and English Translation for Chinese Patent Appl. No. 201780027881.8, dated Mar. 3, 2021, 25 Pages.

Office Action for U.S. Appl. No. 16/091,835, dated Mar. 17, 2021, 5 Pages.

English Translation of Office Action for Chinese Patent Appl. No. 201780027881.8, dated Jul. 14, 2020, 15 Pages.

Notice of Allowance for U.S. Appl. No. 16/182,185, dated Sep. 4, 2020, 18 Pages.

Office Action for U.S. Appl. No. 16/831,510, dated Mar. 23, 2021, 23 Pages.

Notice of Allowance for U.S. Appl. No. 16/091,835, dated Apr. 29, 2021, 17 Pages.

Office Action for U.S. Appl. No. 16/091,835, dated Jan. 11, 2021, 20 Pages.

* cited by examiner

RECYCLABLE AND DISPENSABLE CUTLERY UTENSIL

RELATED APPLICATIONS

The present application is a continuation-in-part application of U.S. patent application Ser. No. 12/831,396, filed Jul. 7, 2010, included by reference herein and for which benefit of the priority date is hereby claimed.

FIELD OF THE INVENTION

The present invention relates to cutlery and, more particularly, to recyclable utensils dispensed by a no-touch utensil dispenser.

BACKGROUND OF THE INVENTION

A convergence of factors, such as reduced antibiotic effectiveness coupled with an increasingly fast food directed environment, have combined to create a need for new cutlery utensils. The utensils should be recyclable, dispensable and hygienic. The utensils should also be compatible with point-of-sale single unit dispensing equipment. There are numerous advantages to using disposable plastic cutlery instead of metal cutlery. In addition to lower cost and convenience, plastic cutlery does not require cleaning. Clean-up associated with metal cutlery includes labor costs, materials costs, and equipment costs. Cleaning equipment may not be feasible for some smaller eating establishments or outdoor catering.

Disposable cutlery such plastic spoons, forks, knives, and spoon-fork combination are normally used in casual restaurant, cafeteria, or at catered event settings and are provided by the eating establishment for use in the restaurant and with take-out food. To ensure that this cutlery is provided in a hygienic form, a purveyor often purchases bulk quantities of individual portions of cutlery each pre-sealed in a small bag. The bag may also contain a napkin, dry condiments, and a hand sanitizer wipe. Such bags are generally more expensive than the sum of individual utensils due to the processing and materials necessary to form the bags. Also, these bags may provide more items than the user requires, which is uneconomical.

An option to such prepackaged bags is the presentation of cutlery in a tray or cup positioned near the point of sale. This approach allows the customer to select only the utensils desired. However, this form of supply can be unsanitary and unhygienic if a customer does not take a utensil that is purposely touched or inadvertently brushed against while rummaging through the proffered selection to find the perfect spoon for soup, for example. Airborne pathogens may settle on exposed surfaces of the remaining cutlery. The unregulated dispensing of the cutlery also permits the customer to take more utensils than needed, thus resulting in a lower profit margin for the establishment.

Automated and semi-automated no-touch dispensing of disposable cutlery is the ultimate solution to minimizing cutlery utensil contamination.

SUMMARY OF THE INVENTION

In accordance with the present invention, there is provided recyclable and dispensable hygienic cutlery utensil for use with a no-touch utensil dispenser such as disclosed in U.S. patent application Ser. No. 12/831,396, filed Jul. 7, 2010. A preferred embodiment of the present invention includes a handle portion and head portion. The handle portion provides suitable area for gripping and includes a chamfer on its outer edge for facilitating a predictable release from a utensil dispenser. The head portion is formed into the shape of a common cutlery utensil such as: knife with large radius, tapered knife with large radius, spoon, set of tines (fork), and spoon-fork combination, to name a few. The head portion also includes an escapement feature in its outer edge for facilitating controlled release from the bottom of a stack of utensils. The escapement feature can include a notch or predetermined release radius. Typically in use, a set of utensils is stacked, forming a cartridge which is then inserted into an automated dispensing system.

It would be advantageous to provide a recyclable, hygienic, and dispensable cutlery utensil.

It would also be advantageous to provide a utensil optimized for stacking and dispensing seriatim.

It would also be advantageous to provide utensils that are not touched by human hands from manufacture to dispensing to a user.

It would further be advantageous to provide a utensil designed for a predictable and controlled release from the bottom of a stack of like utensils.

BRIEF DESCRIPTION OF THE DRAWINGS

A complete understanding of the present invention may be obtained by reference to the accompanying drawings, when considered in conjunction with the subsequent, detailed description, in which.

Figure 10:
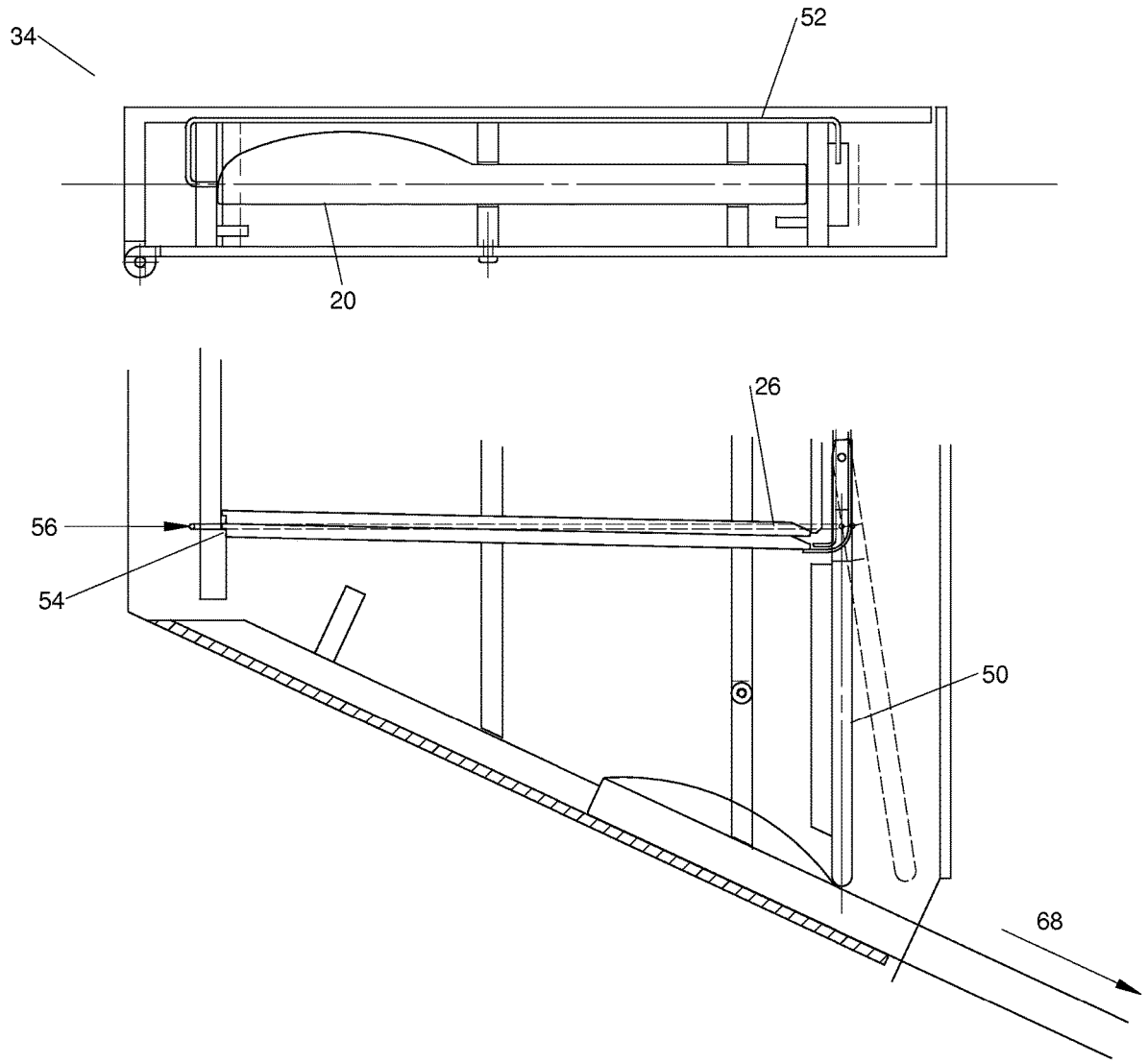

FIG. **9*a*** is a side view of an escapement area of a utensil dispenser prior to the bottommost dispensable utensil is released;

FIG. **9*b*** is a side view of an escapement area of a utensil dispenser after the bottommost dispensable utensil is released;

FIG. 10 is a top section and side view of an escapement area of a utensil dispenser.

Figure 11:
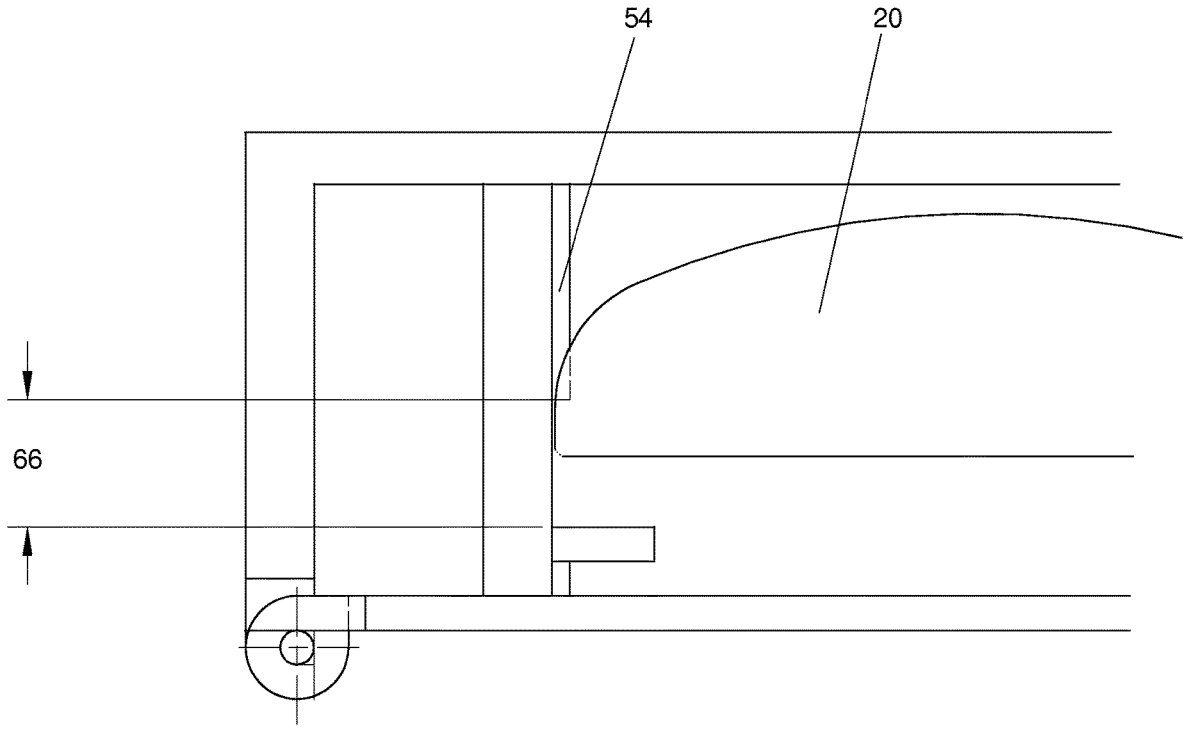
Figure 12:
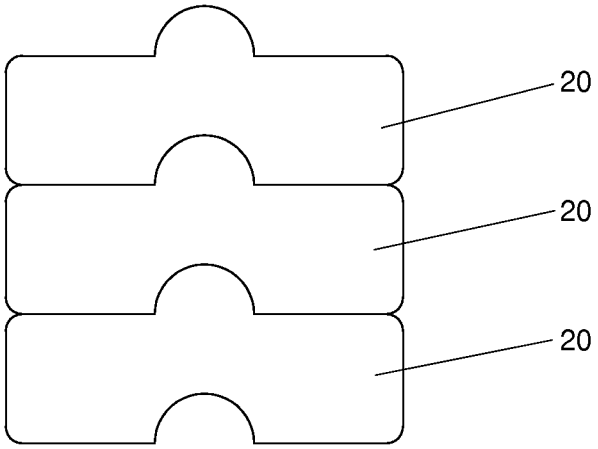

FIG. 11 is a top view of an escapement area of a utensil dispenser with features to enhance utensil rotation; and FIG. 12 is an end view of stacked dispensable utensils in accordance with the invention.

For purposes of clarity and brevity, like elements and components will bear the same designations and numbering throughout the FIGURES.

DESCRIPTION OF THE PREFERRED EMBODIMENT

The invention is a series of utensils that is often deployed in a stack dispensable from a no-touch utensil dispenser 34.

Figure 1:
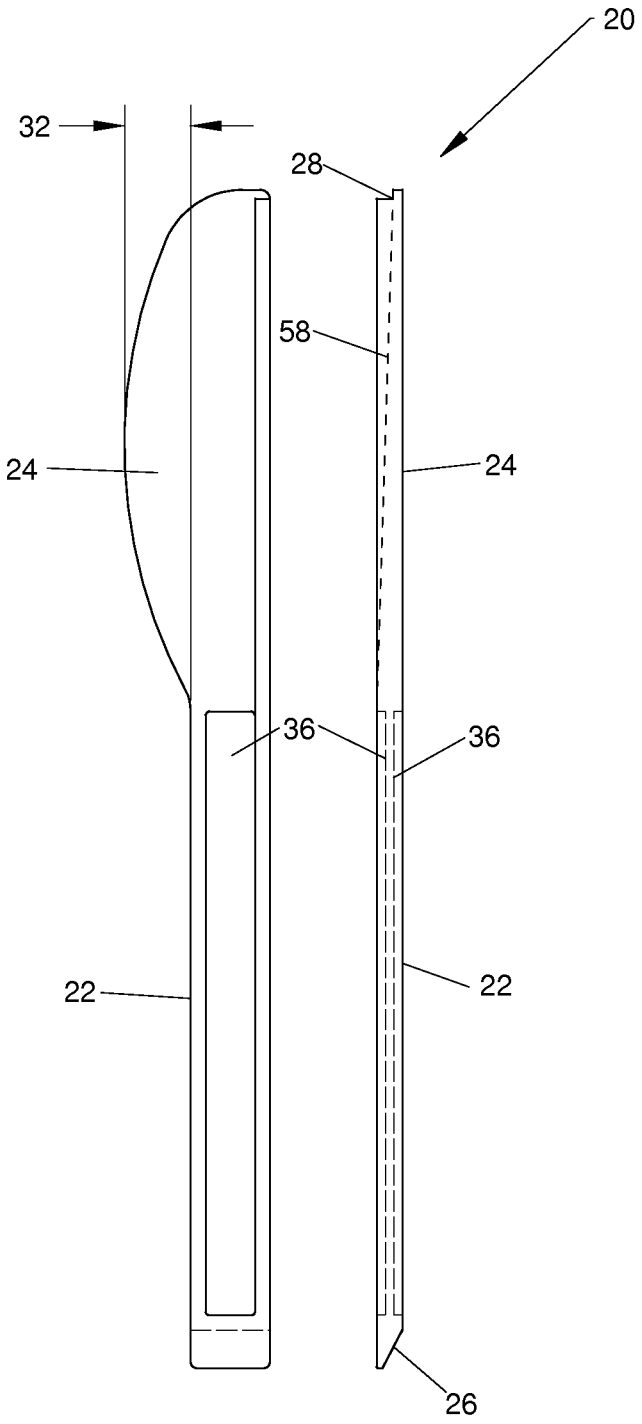
FIG. 1 is a side and bottom view of a dispensable knife with a tapered blade in accordance with the invention.

Referring to FIG. 1, there is shown a side and bottom view of a dispensable utensil 20 with a knife head 24. Utensil 20 may be fabricated from any material(s), but plastic is preferred. The knife head 24 has a tapered blade 58 with large radius 32 and an escapement notch 28 for facilitating release from the bottom of a stack in a utensil dispenser 34 (shown in FIG. 9). Typically a knife head 24 radius is approximately ½ the total length of the utensil 20 (or less) and slightly extends the width of the utensil (up to twice its width).

The handle 22 portion includes a chamfer 26 also facilitating predictable release from a utensil dispenser 34. The handle 22 has a hollowed portion 36.

Figure 2:
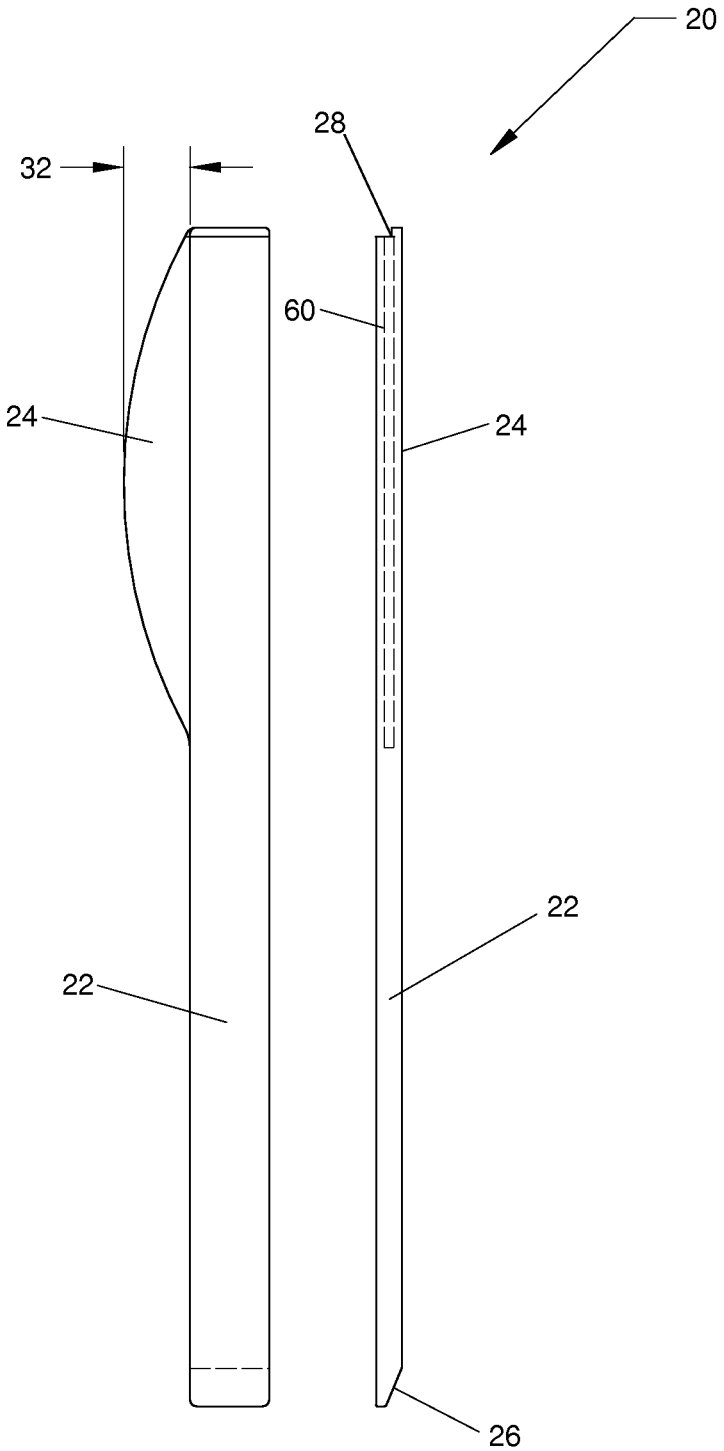
FIG. 2 is a side and bottom view of a dispensable knife with a non-tapered blade in accordance with the invention.

Now referring to FIG. 2, there is shown a side and bottom view of another embodiment of dispensable utensil 20 with a knife head 24. The knife head 24 of this embodiment has a non-tapered blade 60 with large radius 32 and an escapement notch 28 for facilitating release from the bottom of a stack in a utensil dispenser 34 (shown in FIG. 9). The handle 22 portion includes a chamfer 26 also facilitating predictable release from a utensil dispenser 34.

Figure 3:
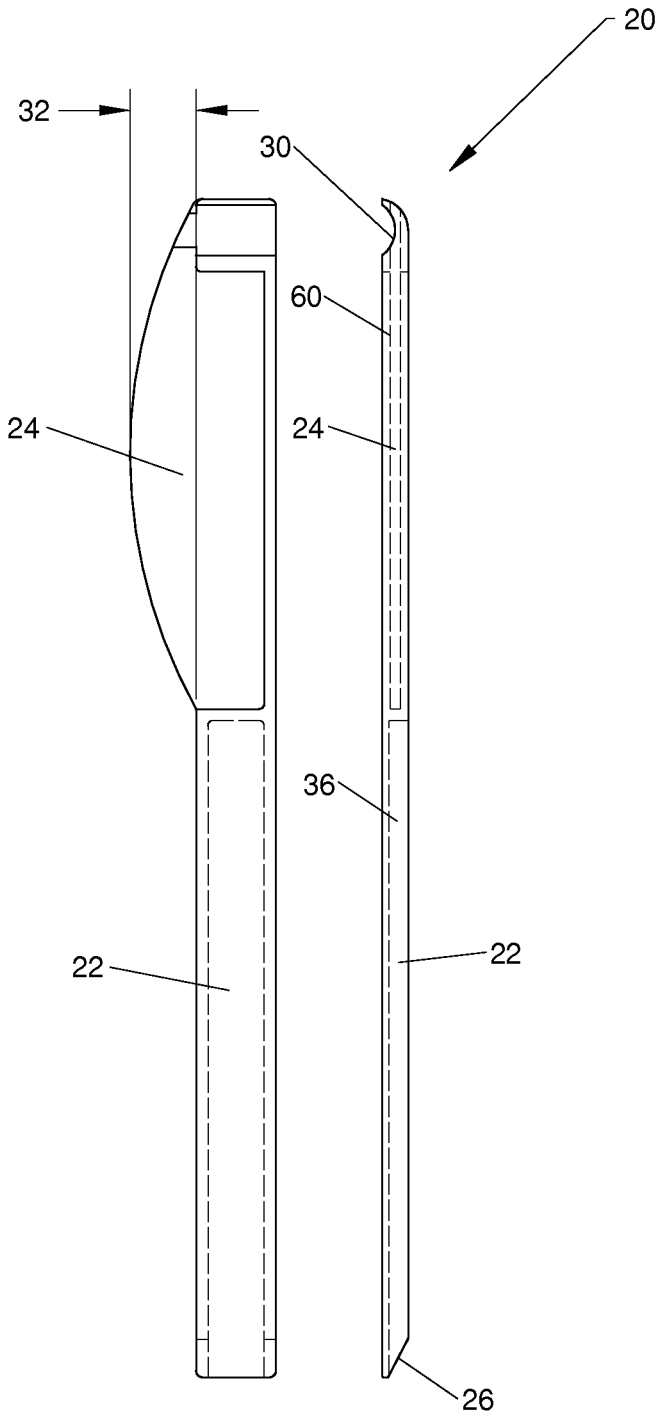
FIG. 3 is a side and bottom view of a dispensable knife with a non-tapered blade and partially hollow handle in accordance with the invention.

Now referring to FIG. 3, there is shown a side and bottom view of yet another embodiment of a dispensable utensil 20 with knife head 24. The knife head 24 has a non-tapered blade 60 with large radius 32 and a predetermined escape release radius 30 for facilitating release from the bottom of a stack in a utensil dispenser 34 (shown in FIG. 9). The handle 22 portion includes a chamfer 26 also facilitating predictable release from a utensil dispenser 34. The handle 22 has a hollowed portion 36.

Figure 4:
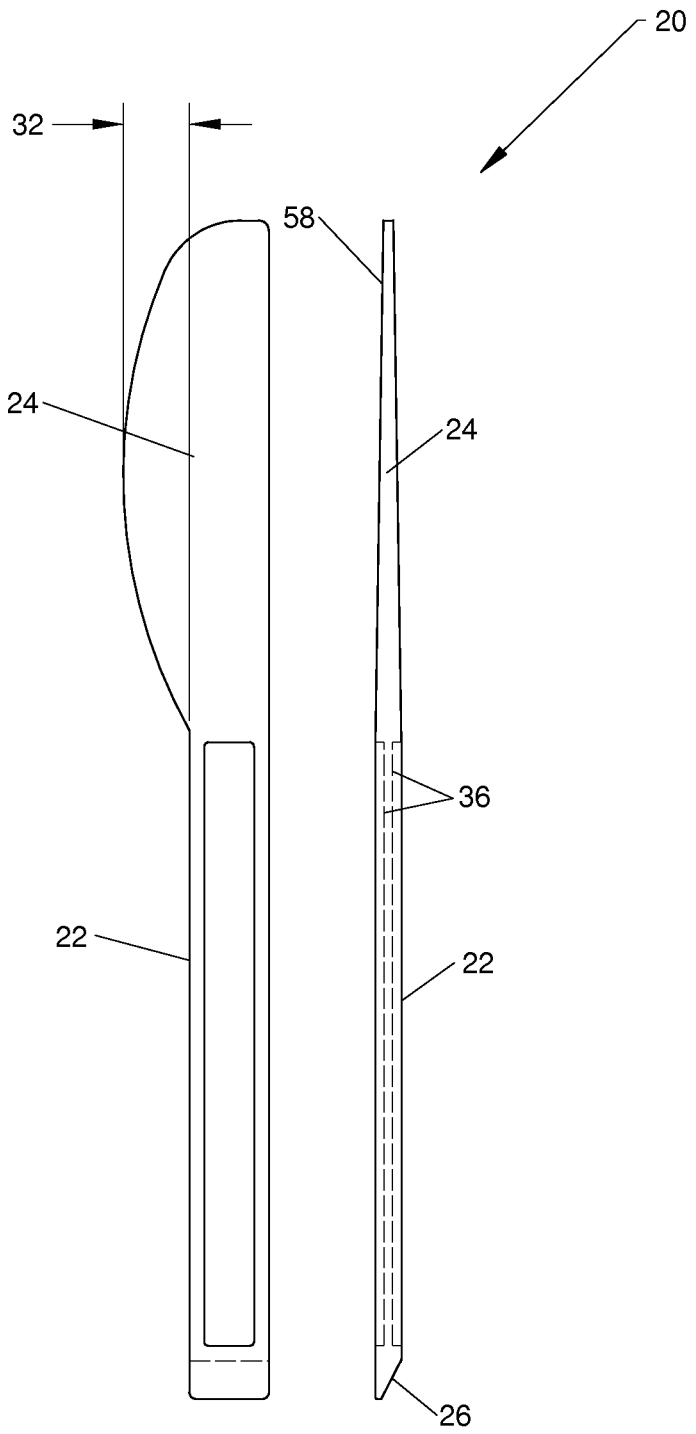
FIG. 4 is a side and bottom view of a dispensable knife with a tapered blade and partially hollow handle in accordance with the invention.

Now referring to FIG. 4, there is shown a side and bottom view of yet another embodiment of a dispensable utensil 20 with knife head 24. The knife head 24 has a tapered blade 58 with large radius 32. The handle 22 portion includes a chamfer 26 for facilitating predictable release from a utensil dispenser 34 (shown in FIG. 9). The handle 22 has a hollowed portion 36.

Figure 5:
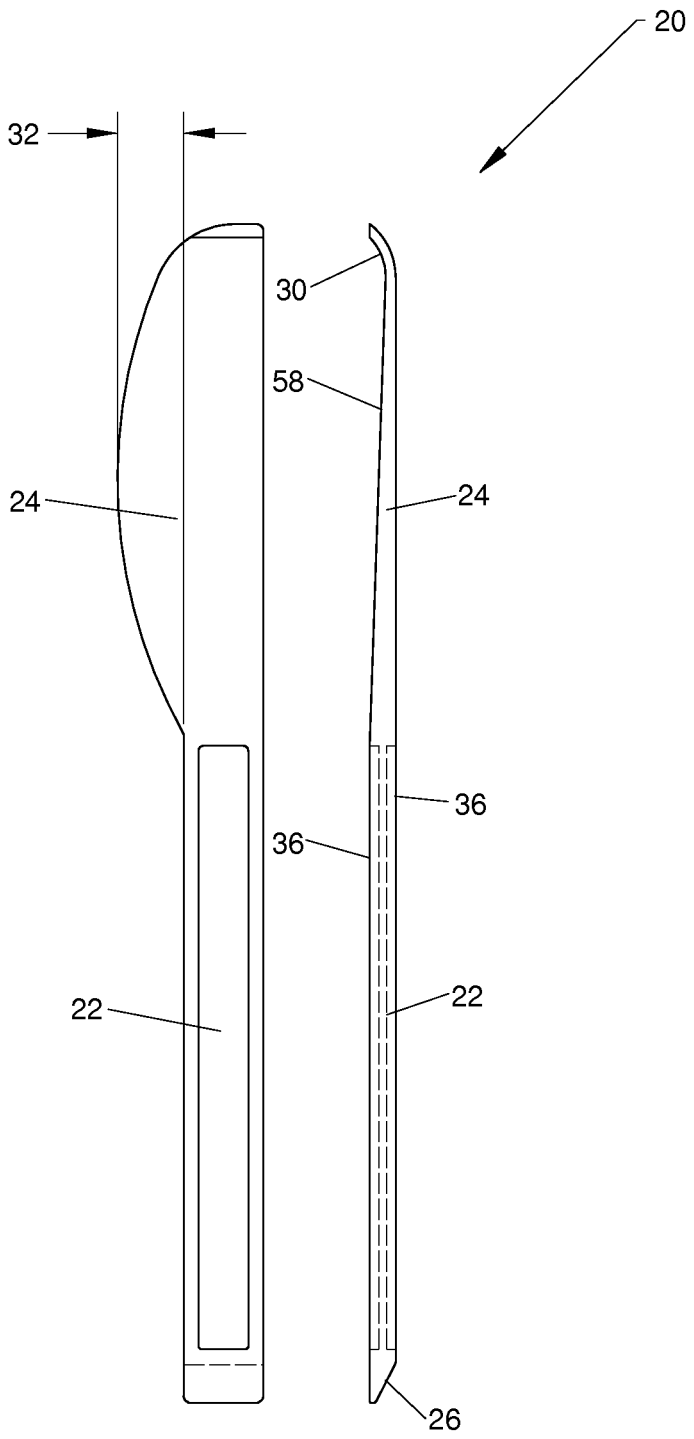
FIG. 5 is a side and bottom view of a dispensable knife with a tapered blade, partially hollow handle, and predetermined escape release radius in accordance with the invention.

Now referring to FIG. 5, there is shown a side and bottom view of yet another embodiment of a dispensable utensil 20 with knife head 24. The knife head 24 has a tapered blade 58 with large radius 32 and a predetermined escape release radius 30 for facilitating release from the bottom of a stack in a utensil dispenser 34 (shown in FIG. 9). The handle 22 portion includes a chamfer 26 also facilitating predictable release from a utensil dispenser 34. The handle 22 has a hollowed portion 36.

Figure 6:
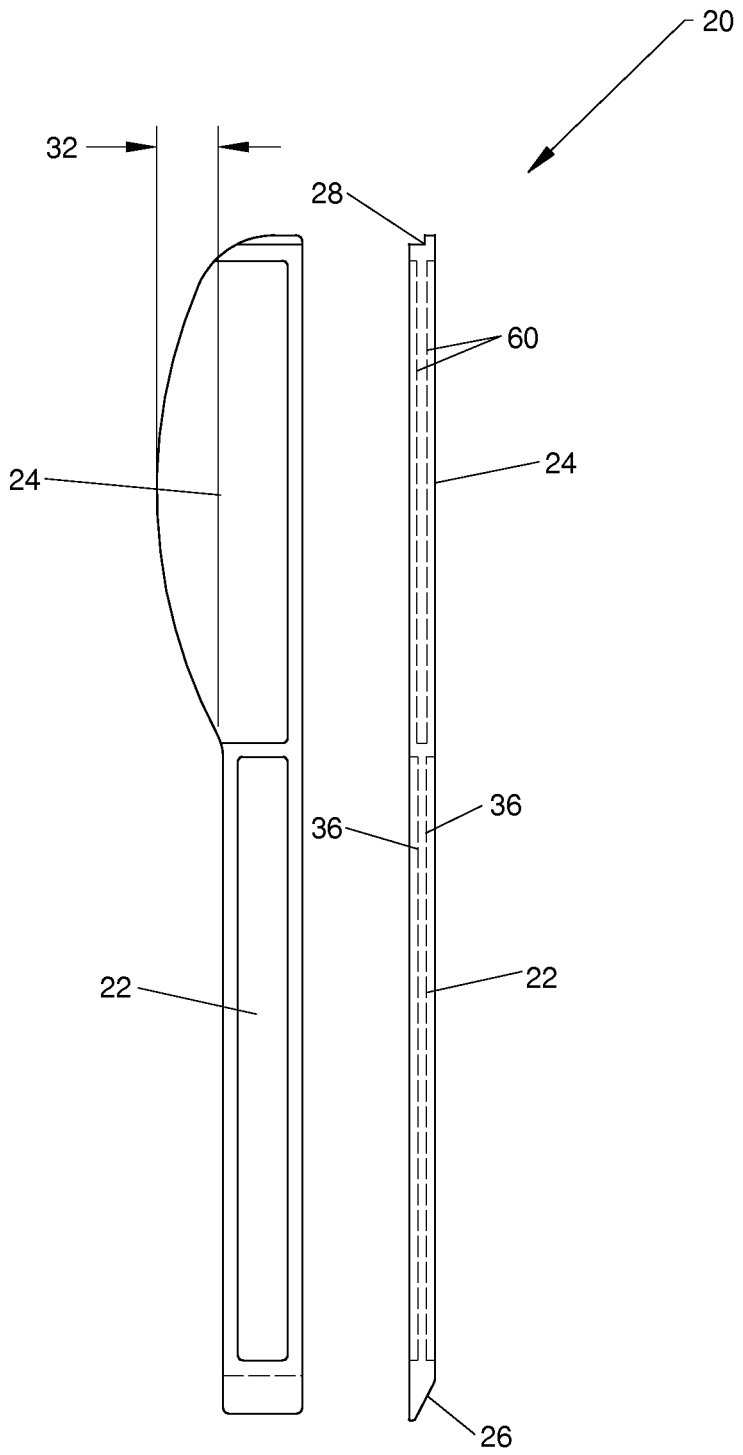
FIG. 6 is a side and bottom view of a dispensable knife with a non-tapered blade, partially hollow handle, and escapement notch in accordance with the invention.

Now referring to FIG. 6, there is shown a side and bottom view of yet another embodiment of a dispensable utensil 20 with knife head 24. The knife head 24 has a non-tapered blade 60 with large radius 32 and an escapement notch 28 for facilitating release from the bottom of a stack in a utensil dispenser 34 (shown in FIG. 9). The handle 22 portion includes a chamfer 26 also facilitating predictable release from a utensil dispenser 34. The handle 22 has a hollowed portion 36.

Figure 7:
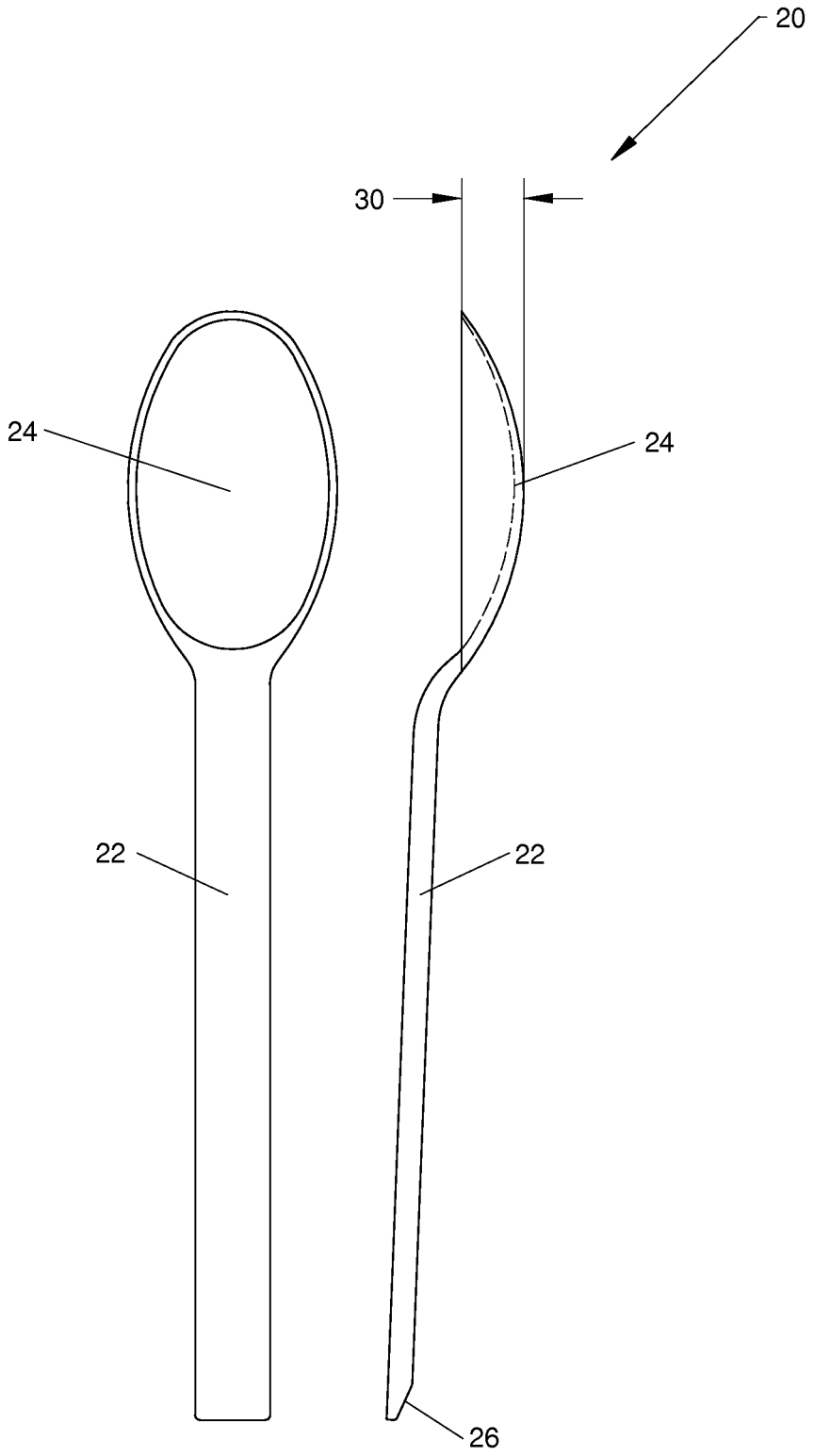
FIG. 7 is a top and side view of a dispensable spoon with a predetermined escape release radius in accordance with the invention.

Now referring to FIG. 7, there is shown a top and side view of yet another embodiment of a dispensable utensil 20 with spoon head 24. The spoon head 24 has a predetermined escape release radius 30 for facilitating release from the bottom of a stack in a utensil dispenser 34 (not shown). The handle 22 portion includes a chamfer 26 also facilitating predictable release from a utensil dispenser 34 (shown in FIG. 9).

Figure 8:
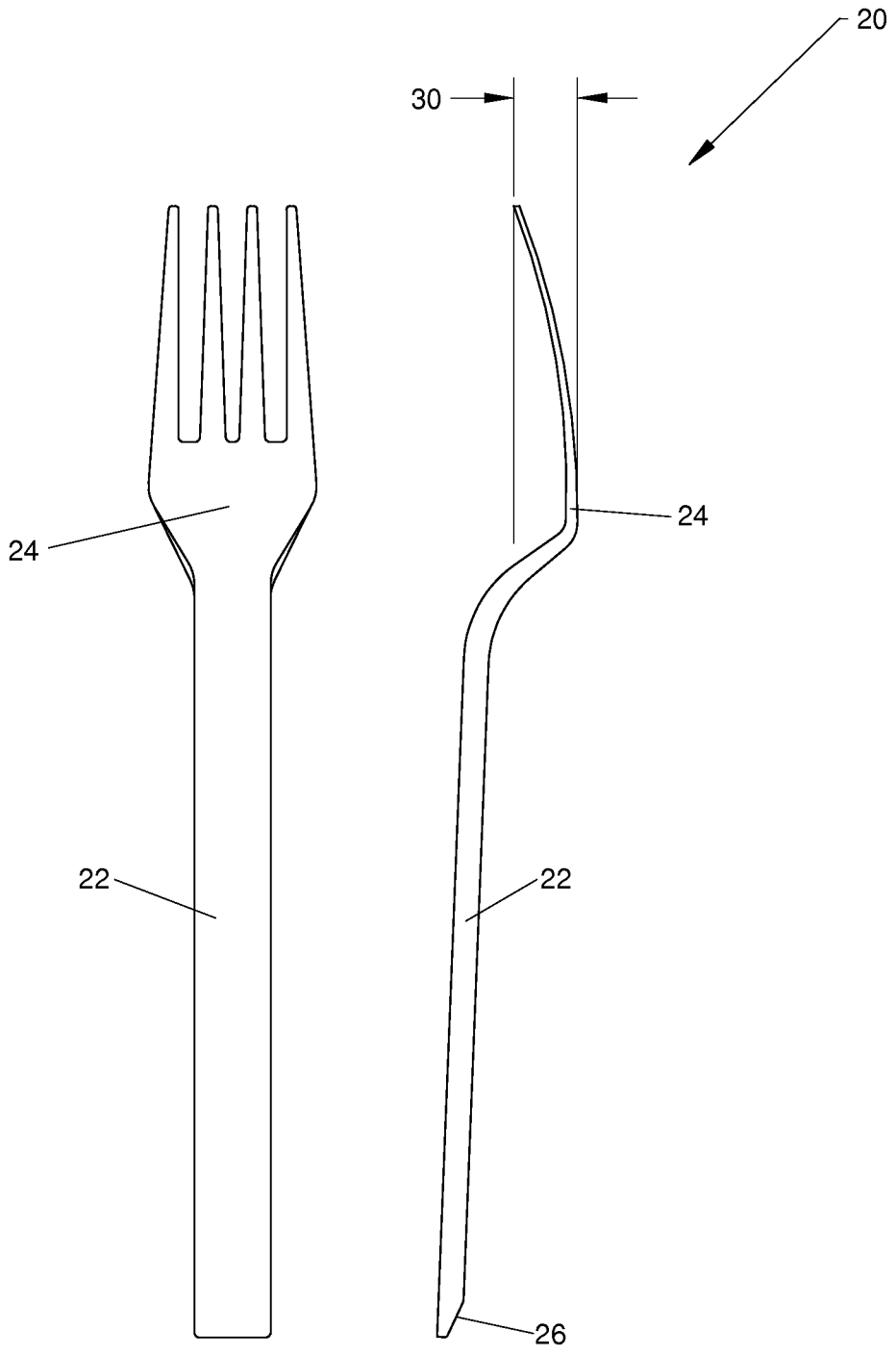
FIG. 8 is a top and side view of a dispensable fork with a predetermined escape release radius in accordance with the invention.

Now referring to FIG. 8, there is shown a top and side view of yet another embodiment of a dispensable utensil 20 with set of tines (fork) head 24. The fork head 24 has a predetermined escape release radius 30 for facilitating release from the bottom of a stack in a utensil dispenser 34 (not shown). The handle 22 portion includes a chamfer 26 also facilitating predictable release from a utensil dispenser 34 (shown in FIG. 9). Head 24 can be combined with spoon head 24 (FIG. 8) to result in a spoon-fork head or Spork®, not shown.

Figure 9A:
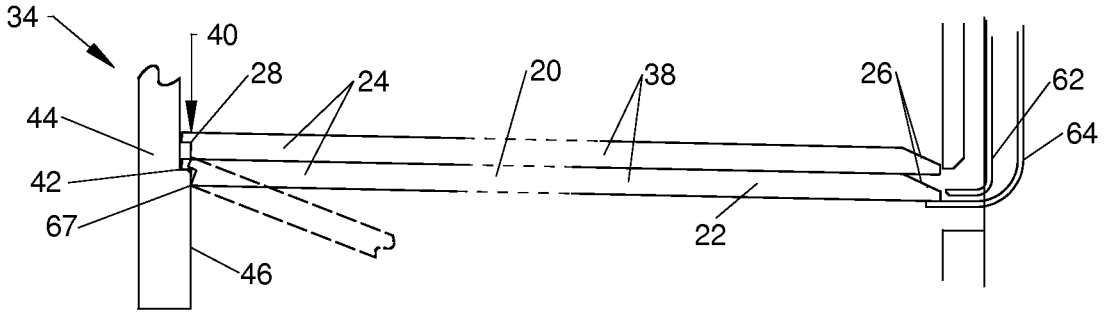
Figure 9B:
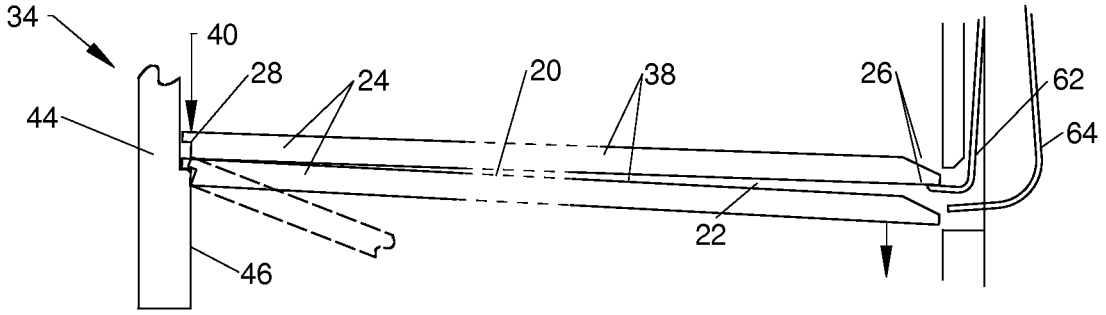

Now referring to FIG. 9*a* and FIG. 9*b*, there is shown a side view of an escapement area of a utensil dispenser 34 prior to releasing the bottommost dispensable utensil 20 and after releasing the bottommost dispensable utensil 20 respectively. The escapement notch 28 on utensil head 24 end is needed to release the bottommost utensil 20 from the utensil stack 38 after the handle 22 end of the utensil 20 is released. The escapement notch 28 is necessary because the frictional forces 40 from the weight of utensil stack 38 pinches this end against the distil end 42 of the escapement back locator bar 44 and will not allow a clean escape. When the handle 22 end is released, the moment loading due to center of gravity of the utensil 20 weight counteracts frictional forces 40 of the utensil 20 and rotates it enough that the notch bottom 67 pushes the utensil 20 away from the vertical surface 46, releasing it vertically downward. The handle chamfer 26 is needed to allow the top escapement finger 62 to smoothly engage the bottom of the utensil handle 22 of the stack to hold them while releasing the lowermost utensil 20. In operation, two escapement fingers of the utensil dispenser 34 are utilized to control the release of the bottommost utensil 20 while retaining remaining utensils. As the consumer activates release of a utensil 20 by pulling a handle (not shown) of the utensil dispenser 34, the bottom escapement finger 64 retracts to release the bottommost utensil 20 while the top escapement finger 62 extends to catch the remaining utensils. After releasing the utensil 20, the utensil dispenser handle is returned to its quiescent position. As the utensil dispenser handle returns to its quiescent position, the bottom escapement finger 64 extends to catch the remaining utensils while the top escapement finger 62 retracts allowing remaining utensils to drop into place onto the bottom escapement finger 64.

Now referring to FIG. 10, there is shown a top and side view of the utensil dispenser 34 rear escapement mechanism 52. The escapement finger 50 is actuated as the utensil 68 is pulled out of the dispenser by a consumer. The rear escapement mechanism 52 is attached to the escapement finger and moves with it to push 56 the utensil 20 off the edge of the rear escapement ledge 54.

Now referring to FIG. 11, there is shown a top view of a utensil dispenser escapement area with features to enhance rotation of knife utensils 20. The knife utensil 20 lays on a distal end rear escapement ledge 54 where a partly removed portion 66 enhances rotational movement when the knife end releases from the distal end.

Now referring to FIG. 12, there is shown an end view of multiple utensils 20 stacked. The utensils upper and lower surfaces are shaped to allow stable stacking.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A system for dispensing a disposable plastic cutlery article comprising a no-touch utensil dispenser having a first escapement finger and a second escapement finger, the plastic cutlery article comprising: a handle having a handle length extending from a first handle end to a second handle end along a longitudinal axis, said handle being configured for gripping said plastic cutlery article, said plastic cutlery article being configured for positioning in the utensil dispenser with the longitudinal axis being generally horizontal; the handle comprising a planar first surface, a planar second surface, a first side, a second side, a shaped region formed into the first handle end, and a stacking region of the handle extending from the shaped region to the second handle end, said first surface extending along substantially all of the handle length from the first handle end to the second handle end, said second surface extending from the shaped region to the second handle end, said first and said second sides extending vertically from mutually opposing edges of said first surface; a head extending from the second handle end along said longitudinal axis, the head being configured for contacting and manipulating food; said plastic cutlery article being configured for alignment in a generally vertical stack of a plurality of identical plastic cutlery articles in said utensil dispenser, wherein the first surfaces of the plurality of identical plastic cutlery articles in said vertical stack are directed downward, the first surface of a bottommost plastic cutlery article in said vertical stack of the plurality of identical plastic cutlery articles being supported by the first escapement finger of said utensil dispenser at the first handle end of the bottommost plastic cutlery article, and wherein the second surface of said bottommost plastic cutlery article is configured to be in physical contact with the first surface of the handle of an adjacent plastic cutlery article in said vertical stack of the plurality of identical plastic cutlery articles; said shaped region formed into the first handle end of the plastic cutlery article providing a handle gap between the first handle end of said bottommost cutlery article and the first surface of said adjacent plastic cutlery article in said vertical stack of said plurality of identical plastic cutlery articles, wherein said handle gap is suitable for insertion therein of the second escapement finger of the utensil dispenser, thereby supporting the first surface of said adjacent plastic cutlery article while the first escapement finger is withdrawn from below the bottommost plastic cutlery article, and the bottommost plastic cutlery article is released from said vertical stack under the sole impulsion of gravity while the adjacent cutlery article is retained in the vertical stack, wherein the first escapement finger overlaps the second escapement finger in a vertical direction.

2. The plastic cutlery article of claim 1, wherein the plastic cutlery article is one of—a spoon, a fork, a knife, and a spork.

3. The plastic cutlery article of claim 1, wherein the head is wider than the handle.

4. The plastic cutlery article of claim 1, wherein the handle gap has a longitudinal depth and a vertical height, and wherein said longitudinal depth is greater than said vertical height.

5. The plastic cutlery article of claim 1, wherein the handle gap has a longitudinal depth and a vertical height, and wherein said vertical height of the handle gap is less than the separation between the first surface of the bottommost plastic cutlery article and the first surface of the adjacent plastic cutlery article in said vertical stack.

6. The plastic cutlery article of claim 1, wherein the shaped region includes a chamfer, wherein the chamfer tapers downwardly from said second surface towards said first handle end.

7. The plastic cutlery article of claim 1, wherein said handle is at least partially hollow.

8. The plastic cutlery article of claim 1, wherein said bottommost plastic cutlery article is retained at an incline in the utensil dispenser after being released from said vertical stack.

9. The plastic cutlery article of claim 1, wherein the stacking region of the handle is vertically bounded by the first surface and the second surface.

10. The plastic cutlery article of claim 1, wherein the handle includes a central region, said central region comprising a protrusion relative to said first surface.

11. A system for dispensing a disposable plastic cutlery article comprising a no-touch utensil dispenser having a first escapement finger and a second escapement finger, the plastic cutlery article comprising: a handle having a handle length extending from a first handle end to a second handle end along a longitudinal axis, said handle being configured for gripping said plastic cutlery article, said plastic cutlery article being configured for positioning in the utensil dispenser with the longitudinal axis being generally horizontal; the handle comprising a planar first surface, a planar second surface, a first side, a second side, a shaped region formed into the first handle end, and a stacking region of the handle extending from the shaped region to the second handle end, said first surface extending along substantially all of the handle length from the first handle end to the second handle end, said second surface extending from the shaped region to the second handle end, said first and said second sides extending vertically from mutually opposing edges of said first surface; a head extending from the second handle end along said longitudinal axis, the head being configured for contacting and manipulating food; said plastic cutlery article being configured for alignment in a generally vertical stack of a plurality of identical plastic cutlery articles in said utensil dispenser, wherein the first surfaces of the plurality of identical plastic cutlery articles in said vertical stack are directed downward, the first surface of a bottommost plastic cutlery article in said vertical stack of the plurality of identical plastic cutlery articles being supported by the first escapement finger of said utensil dispenser at the first handle end of the bottommost plastic cutlery article, and wherein the second surface of said bottommost plastic cutlery article is configured to be in physical contact with the first surface of the handle of an adjacent plastic cutlery article in said vertical stack of the plurality of identical plastic cutlery articles; said shaped region formed into the first handle end of the plastic cutlery article providing a handle gap between the first handle end of said bottommost cutlery article and the first surface of said adjacent plastic cutlery article in said vertical stack of said plurality of identical plastic cutlery articles, said handle gap having a longitudinal depth and a vertical height, wherein said longitudinal depth of the handle gap is greater than said vertical height of the handle gap; said handle gap being suitable for an insertion therein of the second escapement finger of the utensil dispenser, thereby supporting the first surface of said adjacent plastic cutlery article while the first escapement finger is withdrawn from below the bottommost plastic cutlery article, and the bottommost plastic cutlery article is released from said vertical stack under the sole impulsion of gravity while the adjacent cutlery article is retained in the vertical stack, wherein the first escapement finger overlaps the second escapement finger in a vertical direction.

12. The plastic cutlery article of claim 11, wherein the plastic cutlery article is one of a spoon, a fork, a knife, and a spork.

13. The plastic cutlery article of claim 11, wherein the head is wider than the handle.

14. The plastic cutlery article of claim 11, wherein said vertical height of the handle gap is less than said vertical stacking distance.

15. The plastic cutlery article of claim 11, wherein the shaped region includes a chamfer, wherein the chamfer tapers downwardly from said second surface towards said first handle end.

16. The plastic cutlery article of claim 11, wherein said handle is at least partially hollow.

17. The plastic cutlery article of claim 11, wherein said bottommost plastic cutlery article is retained at an incline in the utensil dispenser after being released from said vertical stack.

18. The plastic cutlery article of claim 11, wherein the handle being vertically bounded by the first surface and the second surface.

19. The plastic cutlery article of claim 11, wherein the handle includes a central region, said central region comprising a protrusion relative to said first surface.

* * * * *